United States Patent [19]

Hung

[11] Patent Number: 4,473,726

[45] Date of Patent: Sep. 25, 1984

[54] CONTACT PIN AND MOUNTING CONSTRUCTION FOR MULTIPOLE DATA SWITCH

[75] Inventor: Peter Hung, Stony Brook, N.Y.

[73] Assignee: Porta Systems Corp., Syosset, N.Y.

[21] Appl. No.: 424,212

[22] Filed: Sep. 27, 1982

[51] Int. Cl.[3] ..... H01H 19/54

[52] U.S. Cl. ..... 200/11 G; 200/11 A; 200/11 K; 200/238

[58] Field of Search ..... 200/6 A, 8 R, 8 A, 11 R, 200/11 A, 11 G, 11 J, 11 K, 16 R, 16 B, 16 C, 16 D, 155 R, 155 A, 238–247, 252, 253, 258, 260, 271, 274, 283, 284

[56] References Cited

U.S. PATENT DOCUMENTS

| | | | |
|---|---|---|---|
| 2,115,069 | 4/1938 | Hall | 200/11 K |
| 2,127,608 | 8/1938 | Manley | 200/11 J |
| 2,629,787 | 2/1953 | Coles, Jr. et al. | 200/11 K |
| 3,045,075 | 7/1962 | Van Dyke | 200/11 G X |
| 3,098,130 | 6/1963 | Clavel | 200/11 A |
| 3,225,149 | 12/1965 | Shlesinger, Jr. | 200/16 D |
| 3,263,033 | 7/1966 | Metzger | 200/8 A |
| 3,311,717 | 3/1967 | Lace | 200/8 R |
| 3,368,041 | 2/1968 | Chambaut | 200/11 A |
| 3,383,478 | 5/1968 | Mandel | 200/8 R |
| 3,538,269 | 11/1970 | Long | 200/11 J |
| 3,643,042 | 2/1972 | Gratz | 200/16 D |
| 3,715,527 | 2/1973 | Trevisiol | 200/11 K |
| 3,856,999 | 12/1974 | Terry et al. | 200/11 K |
| 3,961,145 | 6/1976 | Halbeck | 200/11 A X |
| 4,052,573 | 10/1977 | Kojima | 200/11 DA |
| 4,171,470 | 10/1979 | Gettig | 200/6 A |
| 4,348,556 | 9/1982 | Gettig et al. | 200/6 A X |

*Primary Examiner*—J. R. Scott

*Attorney, Agent, or Firm*—Charles E. Temko

[57] ABSTRACT

An improved terminal pin and mounting construction therefor, for use in multicontact switches using flexible wire type contacts mounted upon a stator element, the contacts being bridged by corresponding contacts on a coaxially mounted rotor element. The mounting utilizes improved flexibility of the contact portion of each of the pins to lessen the stress placed upon the fixed mounting portion thereof.

2 Claims, 3 Drawing Figures

FIG. 1
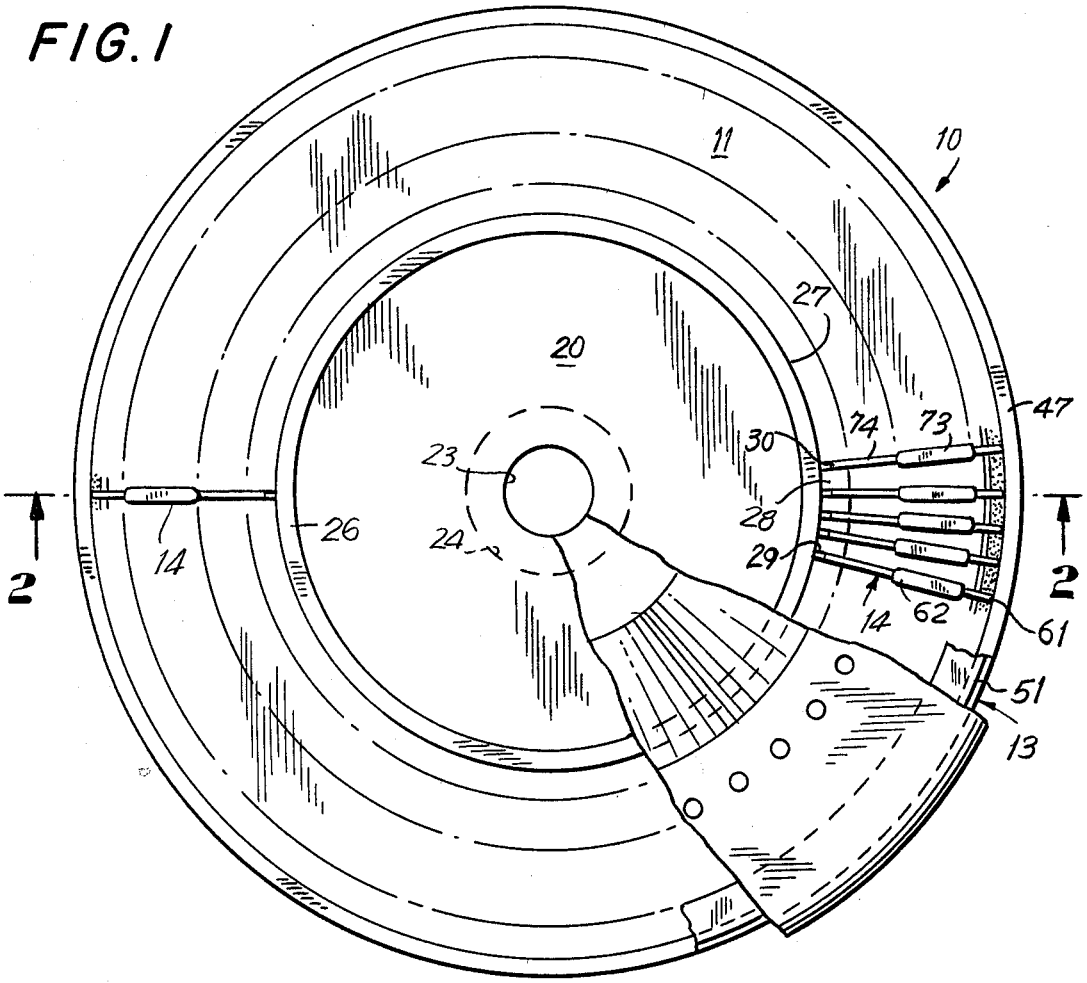
FIG. 2
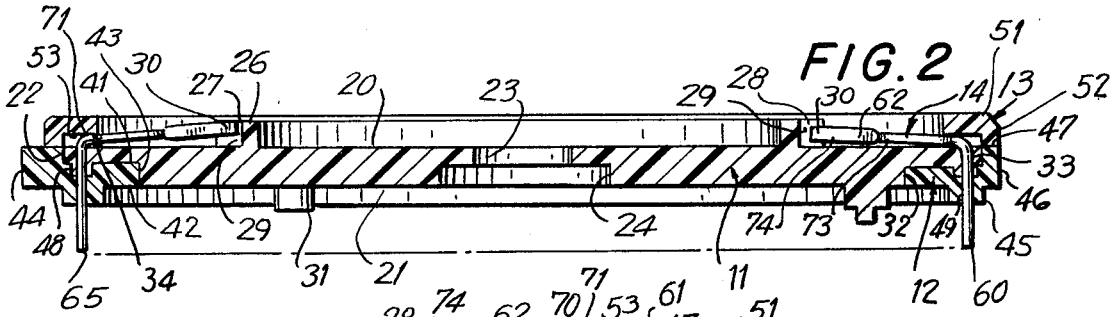
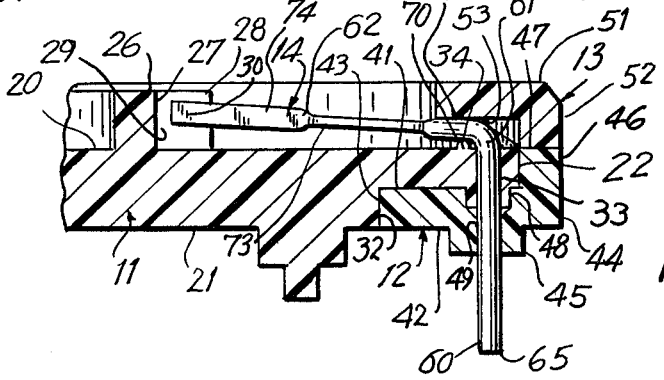
FIG. 3

CONTACT PIN AND MOUNTING CONSTRUCTION FOR MULTIPOLE DATA SWITCH

RELATED APPLICATION

Reference is made to the copending application of Paul V. De Luca and David Rawlings, Ser. No. 310,124, filed Oct. 9, 1981, under the title "Multipole Data Switch", and copending application of Peter C. Hung, Ser. No. 420,322, filed Sept. 20, 1982, under the title "Multipole Data Switch" said applications being assigned to the same assignee as the instant application, and disclosing and claiming a related invention.

BACKGROUND OF THE INVENTION

This invention relates generally to the field of rotary and linear electric switches with bridging contacts commonly used to selectively connect a large number of independent circuits by moving one set of contacts relative to the other. More particularly, it relates to a switch of the type in which the construction thereof has been substantially simplified to result in ease of manufacture, improved reliability, and relatively low production cost. Devices of this general type are well known in the art, and the invention lies in specific constructional details shown in the disclosed embodiment.

In prior art constructions, it is common to provide a relatively fixed stator mounting a plurality of sets of contacts, and a rotor having resiliently urged pins which selectively bridge the contacts on the stator to establish electrical connection therebetween. Adequate contact depends upon the presence of compression of spring-pressed pins, the tension of which weakens with use, as does the ability of the rotor contact to wipe the surface of the contacts on the stator to remove accumulated oxides thereon.

In many constructions, a mechanical detent means must be provided to selectively affix the adjustment of the stator relative to the rotor. The detenting structure also wears with use, and the snap action of the rotor deteriorates as a result.

In the above identified related application, the invention includes the provision of an improved rotary data switch of the class described, in which the contacts on the stator are formed from short lengths of wire in which first portions thereof pass through the body of the stator to provide a conductive terminal, and second portions thereof are bent through substantially a right angle to lie in the path of bridging contacts extending from a surface of the rotor. As the rotor is moved, the bridging contacts deflect the second portions of the wire to provide a wiping effect tending to remove accumulated oxides and other insulative substances, and depress the second portions to place the same under compression. A plurality of individual fins or septums are positioned between adjacent second portions of the wire to prevent any rotational movement thereof about an axis passing through the first portions thereof, the septums forming vertically oriented pockets within which the second portions of the wires may deflect.

In the above mentioned copending application, the stator is provided with resilient sockets into which the wires are laterally inserted during assembly, and axial movement of the wires within the sockets is limited by a flattened area on the wires immediately adjacent the resilient sockets. This mounting relies upon the resiliency of the materials forming the sockets, and in practice, with passage of time, the anchorage has not proven to be as durable as the remaining parts of the device.

SUMMARY OF THE INVENTION

Briefly stated, the invention contemplates the provision of an improved data switch of the type described in the above identified application, in which the mounting of the contact pins, and the configuration of the pins themselves have been materially simplified to facilitate the manufacture of the device without loss of any of the advantages inherent in the earlier construction. The angularly shaped contact wires forming the contacts to be bridged are not resiliently mounted upon the stator, but are positively cemented in place within circular sockets which are not placed under stress. The contact portion of the wire, as distinguished from the mounting portion of the wire, is provided with a flattened area to improve flexibility, and lessen the amount of force necessary to deflect the same upon making contact with corresponding contacts on the rotor. This materially decreases the amount of stress placed on the mounting portion of the pin to further enhance the permanence of the mounting. A peripheral clamping ring engages that part of the contact portion immediately adjacent the mounting portion of the pin to positively locate the free end of the contact portion at a predetermined position so that minimum deflection will occur when the contact portion is contacted by corresponding contacts on the rotor element.

BRIEF DESCRIPTION OF THE DRAWING

In the drawing, to which reference will be made in the specification, similar reference characters have been employed to designate corresponding parts throughout the several views.

FIG. 1 is a top plan view of an embodiment of the invention.

FIG. 2 is a transverse central sectional view thereof.

FIG. 3 is an enlarged fragmentary sectional view corresponding to the right hand portion of FIG. 2.

DETAILED DESCRIPTION OF THE DISCLOSED EMBODIMENT

With reference to the accompanying drawing, in accordance with the invention, reference character 10 designates a stator element, the details of which correspond to those in the above identified copending application. The stator element, like its corresponding rotor element (shown in FIG. 1) with plural contacts 9, is most conveniently formed as a synthetic resinous injection molding. The stator includes a base member 11, an annular wire mounting member 12, an annular tensioning member 13 and a plurality of contact wires 14.

The base member 11 is bounded by an upper surface 20, a lower surface 21 and a peripheral edge surface 22. A centrally disposed bore 23 and counterbore 24 provide means for rotatably interconnecting the stator element with the rotor element in known manner.

Extending upwardly, as seen in FIG. 2, from the upper surface 20 is an arcuate wall 26, an outer surface 27 of which mounts a plurality of septums 28 forming vertical passageways 29 therebetween, each accommodating a portion of an individual wire 14 at the free end 30 thereof. Extending downwardly from the lower surface 21 are a plurality of projections 31 which permit the stator to be mounted upon a support (not shown) and anchored against relative rotation therewith. An annular rabbet 32 accommodates the member 12, and underlies a plurality of wire contact retaining bores 33 extending between the surfaces 20 and 21. An annular rib 34 forms one part of a clamp in conjunction with the tensioning member 13.

The mounting member 12 is also preferably formed as synthetic resinous molding, and is bounded by an upper surface 41, a lower surface 42, an inner peripheral surface 43 and an outer peripheral surface 44. A lower reinforcing bead 45 underlies the bores 33, and includes an upstanding peripheral wall 46 having an upper surface 47 coextensive with the surface 20. A continuous pocket 48 surrounds bores 49 for the retention of an adhesive (not shown) which may be of an epoxy or similar type.

The tensioning member 13 is, again, a molded unit and is of generally L-shaped cross section most clearly seen in FIG. 3. It includes a radially extending wall 51 and a peripheral transverse wall 52. A lower surface 53 of the wall 51 is adapted to contact portions of the contact wires 14, and form the other half of a clamp which immobilizes that segment of the wires clamped therebetween.

The contact wires 14 resemble generally those disclosed in the above mentioned copending application, and, as best seen in FIG. 3, each includes a mounting portion 60, a bent portion 61 and a contact portion 62. In the preferred embodiment, the wire stock from which they are formed is approximately 0.020 inch. The mounting portions 60 thereof are disposed in aligned bores 33 and 49, and are adhesively adhered thereto using the same adhesive which interconnects the members 11 and 12. A free end 65 extends downwardly from the member 12 to permit wire wrapping or other interconnecting means for current transmission.

The bent portion 61 has a configuration slightly less than that of a right angle, and forms a point contact 70 with the rib 34 and a line contact area 71 with the surface 53 when the tensioning member 13 is adhesively secured to the assembly. The contact portion 62 lies inwardly of the clamped segment, and includes a flattened segment 73 of thickness approximating one-half that of the effective diameter of the wire, e.g., approximately 0.010 inch. A further inwardly extending segment 74 terminating in the end 30 remains in rounded configuration.

It will be apparent that when the rotor element 10 is assembled, all flexing will be confined to the flattened segment 73, thereby substantially reducing the tendency of the contact wire 14 to loosen in its mounting. By flattening the segment 73, the amount of force reaction created is minimized, and substantially no strain is transmitted beyond the outer end of the segment 73.

I wish it to be understood that I do not consider the invention limited to the precise details of structure shown and set forth in this specification, for obvious modifications will occur to those skilled in the art to which the invention pertains.

I claim:

1. In a rotary type data switch including stator and rotor elements each having contacts thereon cooperating with contacts on the other, one of said stator and rotor elements having flexible wire contacts of generally L-shaped configuration including a fixed mounting portion and a flexible contact portion interconnected by a bent portion, the improvement comprising: said one of said stator and rotor elements including a main body of generally planar configuration and having an arcuately shaped peripheral area having transversely extending bores therein of diameter corresponding to that of said fixed mounting portion of said wire contacts, said fixed mounting portions being adhesively secured within said bores; an annular tensioning member secured to said main body having a surface thereon contacting said bent portions of each of said wire contacts and exerting a clamping force thereon against said main body portion; said flexible contact portions of said wire contacts including a terminal segment lying in the path of a corresponding contact member on the other of said stator and rotor elements, and a portion of reduced thickness and increased flexibility disposed between said bent portion and said terminal segment; whereby, during use, said bent portion of each of said contact wires is rigidly clamped between said tensioning member and said base member, and all flexing is confined to said portion of reduced thickness.

2. The improvement set forth in claim 1, further comprising a separate wire mounting member having bores corresponding to those in said base member, and aligned therewith, said mounting member being adhesively secured to a surface of said base member and defining a recess therein in the area of said bores for the retention of an adhesive in direct contact with a surface of said contact wires.

* * * * *